US008007973B2

(12) United States Patent
Fuwa et al.

(10) Patent No.: US 8,007,973 B2
(45) Date of Patent: Aug. 30, 2011

(54) FULL-COLOR TONER KIT, PROCESS CARTRIDGE, AND IMAGE FORMING METHOD

(75) Inventors: Kazuoki Fuwa, Toyonaka (JP); Yoshihiro Mikuriya, Nishinomiya (JP); Masayuki Hagi, Minoh (JP); Hideaki Yasunaga, Ibaraki (JP); Hiroaki Katoh, Nagaokakyo (JP); Yoshitaka Sekiguchi, Nishinomiya (JP)

(73) Assignee: Ricoh Company, Limited, Tokyo (JP)

( * ) Notice: Subject to any disclaimer, the term of this patent is extended or adjusted under 35 U.S.C. 154(b) by 878 days.

(21) Appl. No.: 11/965,522

(22) Filed: Dec. 27, 2007

(65) Prior Publication Data

US 2008/0159777 A1 Jul. 3, 2008

(30) Foreign Application Priority Data

Dec. 27, 2006 (JP) ..... 2006-350768

(51) Int. Cl.
*G03G 9/08* (2006.01)

(52) U.S. Cl. ..... 430/107.1; 430/42.1; 430/108.8

(58) Field of Classification Search ..... 430/107.1, 430/42.1, 108.8; 399/252
See application file for complete search history.

(56) References Cited

U.S. PATENT DOCUMENTS

| | | | | |
|---|---|---|---|---|
| 7,556,906 | B2 * | 7/2009 | Katoh et al. | 430/108.8 |
| 2003/0108808 | A1 * | 6/2003 | Inoue et al. | 430/108.8 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |
| 2007/0217842 | A1 | 9/2007 | Kato et al. | |
| 2007/0238042 | A1 | 10/2007 | Yasunaga et al. | |

FOREIGN PATENT DOCUMENTS

| | | |
|---|---|---|
| JP | 09-297432 | 11/1997 |
| JP | 2001-117282 | 4/2001 |
| JP | 2001-312102 | 11/2001 |
| JP | 2004-070005 | 3/2004 |
| JP | 2006-133348 | 5/2006 |

OTHER PUBLICATIONS

U.S. Appl. No. 11/624,525, filed Jan. 18, 2007, Yasunaga, et al.*

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

A full-color toner kit including yellow, magenta, and cyan toners each including a benzimidazolone, a naphthol, and a copper phthalocyanine colorants, respectively, and resins (A) and (B) each of which having a polyester skeleton and containing a wax, and a resin (C) having a polyester skeleton and containing no wax. Each of the toners has a softening point of from 125° C. to 135° C. The following relationships are satisfied: $Ts(A)<Ts(B)$, $Ay+5 \leqq Am \leqq Ay+15$, and $Ac+5 \leqq Am \leqq Ac+15$, wherein Ts(A) and Ts(B) (° C.) each represent softening points of the resin (A) and (B), respectively, and Ay, Am, and Ac each represent ratios (% by weight) of the amount of the resin (A) to total amount of the resins (A) and (B) in the yellow, magenta, cyan toners, respectively.

14 Claims, 1 Drawing Sheet

FULL-COLOR TONER KIT, PROCESS CARTRIDGE, AND IMAGE FORMING METHOD

CROSS-REFERENCE TO RELATED APPLICATIONS

This document claims priority to and contains subject matter related to Japanese Patent Application No. 2006-350768, filed on Dec. 27, 2006, the entire contents of which are incorporated herein by reference.

BACKGROUND

1. Field of the Invention

The present invention relates to a full-color toner kit, a process cartridge, and an image forming method for use in electrophotography.

2. Discussion of the Background

New models of consumer oriented laser printers are often expected to be smaller in size, lower in cost, and higher in printing speed than previous models.

To make a printer smaller in size, a fixing device can be made to include two rollers without an oil applicator. As an alternative to applying oil to a fixing roller, a toner for use in such a fixing device may include a release agent (e.g., a wax) so that the fixed toner image can easily separate from the fixing roller. If the toner includes too much wax, the toner may have too large a cohesion force. As a result, the toner may excessively stick to a control blade that charges the toner, and therefore the resultant image can have white line defects. (This phenomenon is hereinafter referred to as the "toner-sticking problem".)

As colorants for use in toners, naphthol, benzimidazolone, and copper phthalocyanine can be used as magenta, yellow, and cyan colorants, respectively. As resins for use in toners, a combination of a resin containing a wax capable of improving dispersibility of the wax in the resultant toner and a resin having a lower softening point capable of increasing translucency, color reproducibility, and glossiness of the resultant image is typically used.

When yellow, magenta, and cyan toners each include the same amount of resin containing a wax and resin having a low softening point so that each toner includes the same amount of the wax, the magenta toner has a higher softening point compared to the other toners. Therefore, the magenta toner tends to cause an offset problem in that a part of a fused toner image is adhered and transferred to the surface of a heat member and then the part of the toner image is re-transferred to an undesired portion of the sheet itself or the following sheet of a recording material at low temperatures.

Japanese Patent No. 3584141 describes a toner including three kinds of resins to improve thermal properties of the toner. However, no attempt is made in this reference to adjust the mixing ratio of the resins according to the kind of colorant used.

Published unexamined Japanese Patent Application No. 2004-70005 describes a red toner including a polyester resin and a naphthol colorant. It is described therein that the toner overcomes disadvantages of a combination of a polyester resin and a naphthol colorant. However, the red toner is not necessary to produce full-color images, and does not solve the problem of the magenta toner.

SUMMARY

Accordingly, an aspect of the present invention is to provide a full-color toner kit, a process cartridge, and an image forming method capable of producing high quality images without causing the toner-sticking problem and the hot offset problem.

This and other aspects of the present invention, either individually or in combinations thereof, will become more readily apparent as follows. One aspect of the invention provides a full-color toner kit includes a yellow toner with a benzimidazolone colorant, resins (A) and (B) each of which includes a polyester skeleton and containing wax, and resin (C) having a polyester skeleton and containing no wax. This aspect further includes a magenta toner with a naphthol colorant and the resins (A), (B), and (C); and a cyan toner including a copper phthalocyanine colorant, the resins (A), (B), and (C). Each of the yellow, magenta, and cyan toners has a softening point of from 125° C. to 135° C. In this aspect of the invention, the following relationships are satisfied:

$$Ts(A)<Ts(B)$$

$$Ay+5\leqq Am\leqq Ay+15$$

$$Ac+5\leqq Am\leqq Ac+15$$

Ts(A) and Ts(B) (° C.) each represent softening points of the resin (A) and (B), respectively; and Ay, Am, and Ac each represent ratios (% by weight) of an amount of the resin (A) to total amount of the resins (A) and (B) in the yellow, magenta, cyan toners, respectively. Each of the yellow, magenta, cyan toners is typically manufactured by a method including melt-kneading toner components comprising each of the colorant and the resins (A), (B), and (C) to prepare a kneaded mixture. The method also typically includes pulverizing the kneaded mixture to prepare toner particles.

One aspect of the invention includes providing a process cartridge comprising the full-color toner kit and an image forming method using the full-color toner kit.

BRIEF DESCRIPTION OF THE DRAWINGS

These and other aspects, features and advantages of the present invention will become apparent upon consideration of the following description of the preferred embodiment of the present invention taken in conjunction with the accompanying drawing, wherein.

DETAILED DESCRIPTION

Figure 1:
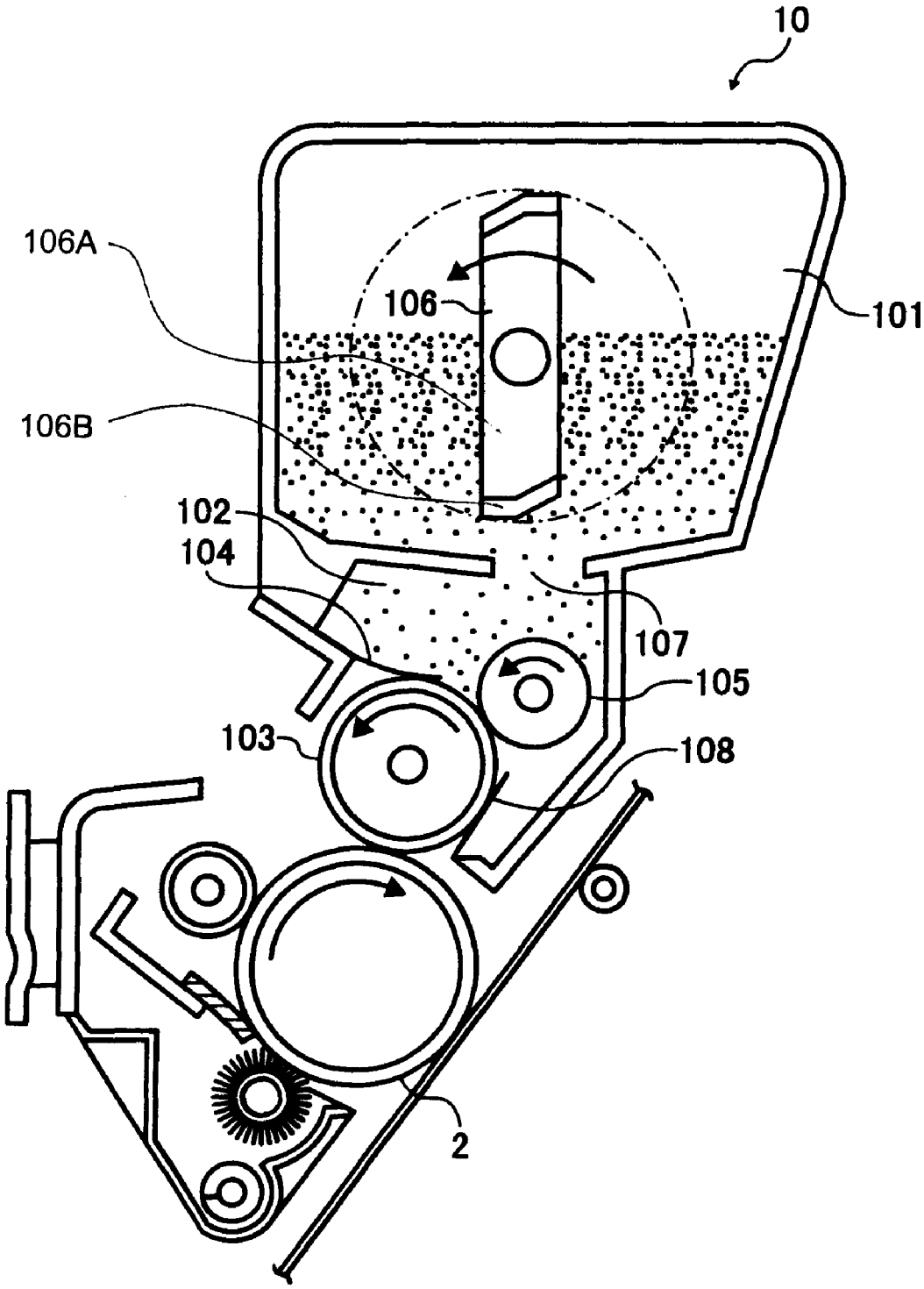
FIG. 1 is a schematic view illustrating one exemplary embodiment of a process cartridge of the present invention.

The yellow, magenta, and cyan toners for use in some embodiments of the present invention each are so-called pulverization toners including resins (A) and (B), each of which includes a polyester skeleton and contains a wax, and a resin (C) having a polyester skeleton and containing no wax. The yellow, magenta, and cyan toners each typically include a benzimidazolone colorant, a naphthol colorant, and a copper phthalocyanine colorant, respectively. In addition, the following relationships are satisfied:

$$Ts(A)<Ts(B) \quad (1)$$

$$Ay+5\leqq Am\leqq Ay+15 \quad (2)$$

$$Ac+5\leqq Am\leqq Ac+15 \quad (3)$$

wherein Ts(A) and Ts(B) (° C.) each represent softening points of the resin (A) and (B), respectively; and Ay, Am, and Ac each represent ratios (% by weight) of the amount of the resin (A) to total amount of the resins (A) and (B) in the yellow, magenta, cyan toners, respectively. Further, each of the yellow, magenta, and cyan toners has a softening point of from 125° C. to 135° C.

When each of a yellow, a magenta, a cyan toners included in a full-color toner kit includes the same amounts of binder resins so that each toner includes the same amount of the wax, the magenta toner has a higher softening point compared to the other toners. Therefore, the magenta toner tends to cause an offset problem at low temperatures. To solve this problem, in one aspect of the present invention, the amounts of the binder resins included in the magenta toner are adjusted so that all of the toners have a softening point of from 125° C. to 135° C. Thereby, the magenta toner has similar thermal properties as the other toners while including the same amount of the wax as the others.

When the above-mentioned relationships (1) to (3) are satisfied, the magenta toner is prevented from having higher thermal properties than the other toners, and has the same or similar thermal properties as the other toners.

The amounts of the resins (B) and (C) are typically determined as appropriate so that the resultant toner includes a desired amount of the wax and has a desired softening point.

Each of the toners preferably has a softening point of from 125° C. to 135° C. When the temperature of the softening point is too high, the offset problem tends to occur at high temperatures. When the temperature of the softening point is too low, the offset problem tends to occur at low temperatures.

(Resin having Polyester Skeleton)

As the resin having a polyester skeleton, a polyester resin formed from a polycondensation reaction between a polyol and a polycarboxylic acid is preferably used. Specific examples of diols include, but are not limited to, alkylene oxide adducts of bisphenol A (e.g., polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane), ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, and hydrogenated bisphenol A.

Specific examples of polyols having three or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of dicarboxylic acids include, but are not limited to, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, and anhydrides and lower alkyl esters thereof.

Specific examples of polycarboxylic acids having three or more valences include, but are not limited to, 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and anhydrides and lower alkyl esters thereof.

As a resin having a polyester skeleton, a resin (hereinafter referred to as a vinyl polyester resin) obtained by subjecting raw material monomers of a polyester resin, raw material monomers of a vinyl resin, and a monomer capable of reacting with both of the raw material monomers to a polycondensation reaction for preparing a polyester resin and a radical polymerization reaction for preparing a vinyl resin, in a reaction vessel at the same time, is also preferably used. The monomer capable of reacting with both of the raw material monomers is, in other words, a monomer capable of both a polycondensation reaction and a radical polymerization reaction. Such a monomer includes a carboxyl group capable of polycondensation reaction and a vinyl group capable of radical polymerization reaction. Specific examples of such monomers include, but are not limited to, fumaric acid, maleic acid, acrylic acid, and methacrylic acid.

As the raw material monomers of a polyester resin, the above-mentioned polyols and polycarboxylic acids can be used. Specific examples of the raw material monomers of a vinyl resin include, but are not limited to, styrenes and styrene derivatives (e.g., o-methylstyrene, m-methylstyrene, p-methylstyrene, α-methylstyrene, p-ethylstyrene, 2,4-dimethylstyrene, p-tert-butylstyrene, p-chlorostyrene), ethylene-based unsaturated monoolefins (e.g., ethylene, propylene, butylene, isobutylene), alkyl esters of methacrylic acids (e.g., methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, dodecyl methacrylate), alkyl esters of acrylic acids (e.g., methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate, dodecyl acrylate), unsaturated carboxylic acids (e.g., acrylic acid, methacrylic acid, itaconic acid, maleic acid), acrylonitrile, maleates, itaconates, vinyl chloride, vinyl acetate, vinyl benzoate, vinyl methyl ethyl ketone, vinyl hexyl ketone, vinyl methyl ether, vinyl ethyl ether, and vinyl isobutyl ether.

Specific examples of polymerization initiators for polymerizing the raw material monomers of a vinyl resin include, but are not limited to, azo or diazo polymerization initiators (e.g., 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile), and peroxide polymerization initiators (e.g., benzoyl peroxide, dicumyl peroxide, methyl ethyl ketone peroxide, isopropyl peroxycarbonate, lauroyl peroxide).

From the viewpoint of improving separability from a fixing roller and hot offset resistance of the resultant toner, the following resins are preferably used with the above-mentioned resins.

As the resins (A) and (B), a vinyl polyester resin obtained by using an alkylene oxide adduct of bisphenol A, terephthalic acid, trimellitic acid, and succinic acid as the raw material monomers of a polyester resin; styrene and butyl acrylate as the raw material monomers of a vinyl resin; and fumaric acid as the monomer capable of both polycondensation reaction and radical polymerization reaction is preferably used.

As the resin (C), a polyester resin obtained by subjecting the above-mentioned polyol and polycarboxylic acid to a polycondensation reaction is preferably used. In particular, an alkylene oxide adduct of bisphenol A is preferably used as the polyol, and terephthalic acid and fumaric acid are preferably used as the polycarboxylic acid.

The resins (A) and (B) each typically internally contain a hydrocarbon wax. The resins (A) and (B) are obtained by reacting raw material monomers in the presence of the hydrocarbon wax. For example, when the resins (A) and (B) are polyester resins, the hydrocarbon wax is mixed with an acid monomer and an alcohol monomer composing a polyester resin, and then the monomers are subjected to a polycondensation reaction. When the resins (A) and (B) are vinyl polyester resins, the hydrocarbon wax is mixed with raw material monomers of a polyester resin while the mixture is agitated and heated. Then, raw material monomers of a vinyl resin are dropped therein, and accordingly the monomers are subjected to a polycondensation reaction and a radical reaction at the same time.

(Wax)

Generally, the lower polarity a wax has, the higher separability from a fixing roller the wax has. Therefore, hydrocarbon waxes having a lower polarity are preferably used with certain aspects of the present invention.

The hydrocarbon wax typically includes only carbon atoms and hydrogen atoms, and includes no ester group, alcohol group, and amide group. Specific examples of the hydrocarbon wax include, but are not limited to, polyolefin waxes (e.g., polyethylene, polypropylene, ethylene-propylene copolymers), petroleum waxes (e.g., paraffin wax, microcrystalline wax), and synthesized waxes (e.g., Fisher-Tropsch wax). Among these waxes, polyethylene wax, paraffin wax, and Fisher-Tropsch wax are preferably used, and polyethylene wax and paraffin wax are more preferably used.

The wax preferably has a softening point of from 70 to 80° C. from the viewpoint of preventing the toner from sticking to image forming members and improving separativeness of the toner from a fixing roller.

(Wax Dispersing Agent)

Toner for use in certain aspects of the present invention may include a wax dispersing agent to assist the dispersion of the wax in the toner. Any known wax dispersing agents can be used. For example, polymers and oligomers including blocks of a unit highly compatible with a wax and blocks of a unit highly compatible with a resin; polymers and oligomers in which one of a unit highly compatible with a wax and a unit highly compatible with a resin is grafted to the other; copolymers of unsaturated hydrocarbons (such as ethylene, propylene, butene, styrene, and α-styrene) and α,β-unsaturated carboxylic acids (such as acrylic acid, methacrylic acid, maleic acid, maleic anhydride, itaconic acid, and itaconic anhydride), esters thereof, and/or anhydrides thereof; block and graft copolymers of vinyl resins and polyester resins; and the like, can be used.

One example material highly compatible with a wax is a long-chain alkyl group having 12 or more carbon atoms; and polyethylene, polypropylene, polybutene, polybutadiene, and copolymers thereof. One material highly compatible with a resin is a polyester resin and a vinyl resin.

In terms of preventing the occurrence of the offset problem at low and high temperatures, the resins (A) and (B) each having a polyester skeleton and containing a wax and the resin (C) having a polyester skeleton and containing no wax preferably typically satisfy the following relationships:

$$130 \leqq Ts(A) \leqq 140$$

$$135 \leqq Ts(B) \leqq 145$$

$$105 \leqq Ts(C) \leqq 115$$

wherein Ts(A), Ts(B), and Ts(C) (° C.) each represent softening points of the resins (A), (B), and (C), respectively.

It is preferable that the wax dispersed in the resins (A) and (B) each has a number average dispersion diameter of from 3 μm to 5 μm.

The number average dispersion diameter can be determined as follows. At first, a resin is cut into an ultrathin section having a thickness of about 100 μm, and dyed with ruthenium tetraoxide. The dyed ultrathin section is observed and photographed with a transmission electron microscope (TEM) at a magnification of 10,000 times. Dispersion diameters of 100 randomly selected dispersed wax particles are measured from the photograph. A histogram in which the horizontal axis represents dispersion diameters, which are divided into units having a width of 0.05 μm, and the vertical axis represents the number of wax particle is obtained. When a dispersed wax particle has a non-spherical shape such as a spindle shape, the dispersion diameter is determined by averaging the major axis and the minor axis thereof.

Each of the resins (A) and (B) preferably includes the wax in an amount of from 3% to 8% by weight from the viewpoint of preventing localization of the wax.

Each of the yellow, magenta, and cyan toners preferably includes the wax in an amount of from 3.0 to 3.5 parts by weight based on 100 parts by weight of each of the toner. When the amount is too small, the resultant toner does not easily separate from a fixing roller, and therefore high quality images are difficult to produce. When the amount is too large, the resultant toner tends to stick onto a control blade, and therefore the resultant image has white-line defects.

The yellow, magenta, and cyan toners for use in the present invention are typically obtained mixing toner components such as the resins (A), (B), and (C), a colorant, and a charge controlling agent.

This proportion process also includes melt-kneading the above-mixed toner components to prepare a kneaded mixture, cooling and pulverizing the kneaded mixture to prepare coarse particles, and classifying the coarse particles to prepare toner particles.

(Charge Controlling Agent)

Toner for use in certain aspects of the present invention may include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of usable commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG;

LRA-901, and LR-147 (boron complex), which are manufactured by Japan Carlit Co., Ltd.; copper phthalocyanine, perylene, quinacridone, and azo pigments and polymers having a functional group such as a sulfonate group, a carboxyl group, and a quaternary ammonium group.

Among these charge controlling agents, compounds capable of negatively charging a toner are preferably used.

The content of the charge controlling agent is typically determined depending on the species of the binder resin used, and toner manufacturing method (such as dispersion method) used, and is not strictly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases. This increase in electrostatic force can result deterioration of the fluidity of the toner and image density of the toner images.

(Colorant)

The magenta toner typically includes a naphthol colorant such as C. I. Pigment Red 57-1. The yellow toner typically includes a benzimidazolone colorant such as C. I. Pigment Yellow 180. The cyan toner typically includes a copper phthalocyanine colorant such as C. I. Pigment Blue 15:3. Each of the toners typically includes a colorant in an amount of from 1% to 15% by weight, and more preferably from 3% to 10% by weight. The colorant can also be combined with a resin to be used as a master batch.

(External Additive)

The toner for use in certain aspects of the present invention typically includes at least one kind of particulate inorganic material as an external additive to improve chargeability, developability, and transferability of the toner. The particulate inorganic material preferably has a BET specific surface area of from 30 to 300 $m^2/g$ and a primary particle diameter of from 10 to 50 nm.

Specific examples of the particulate inorganic material include, but are not limited to, silicon oxide, zinc oxide, quartz sand, titanium oxide, clay, mica, sand-lime, diatom earth, chromium oxide, cerium oxide, red iron oxide, antimony trioxide, magnesium oxide, aluminum oxide, zirconium oxide, barium sulfate, barium carbonate, calcium carbonate, silicon carbide, and silicon nitride.

When the primary particle diameter is too small, the external additive tends to be buried in the toner particles. As a result, the quality of the resultant image varies. When the primary particle diameter is too large, the external additive tends to release from the toner particles. As a result, films of the external additive can be formed on a photoreceptor.

(Full-color Toner Kit)

The full-color toner kit of one aspect of the present invention includes the above-mentioned yellow, magenta, cyan toners in the state they stand separate from one another. The full-color toner kit may be used by setting it in a developing device, an image forming apparatus, or a process cartridge having two or more independent toner containers. It may also have the form of toner cartridges in common use, such as process cartridges or toner cartridges holding toners or developers composed of mixtures of toners and carriers, or cartridges having integral sets of process cartridges and toner cartridges.

(Process Cartridge and Image Forming Method)

FIG. 1 is a schematic view illustrating an embodiment of the process cartridge of the present invention including a developing device.

A developing device 10 comprises a toner containing chamber 101 and a toner supplying chamber 102 provided below the toner containing chamber 101, a developing roller 103, a toner layer thickness control member 104 provided in contact with the developing roller 103, and a supply roller 105. The developing roller 103 is provided in contact with a photoreceptor 2, and a predetermined developing bias is applied thereto from a high-voltage power supply (not shown). A toner agitation member 106 is provided in the toner containing chamber 101 and rotates in the counterclockwise direction. A portion 106A of the toner agitation member 106 in the axial direction where the tip does not pass the vicinity of an opening 107 has a larger surface area so that a toner contained in the toner containing chamber 101 is satisfactorily fluidized and agitated by rotation. A portion 106B of the toner agitation member 106 in the axial direction where the tip passes the vicinity of the opening 107 has a smaller surface area so that an excessive amount of the toner is not introduced to the opening 107. Toner particles present in the vicinity of the opening 107 are agitated with the portion 106B of the toner agitation member 106, and then fall down by gravity feed to the toner supplying chamber 102. The surface of the supply roller 105 is typically covered with a foam material having a cell structure so that toner particles supplied from the toner supplying chamber 102 are efficiently adhered and the toner deterioration caused by the pressure concentration from the developing roller 103 is reduced. The foam material has an electric resistance of from $1\times10^3$ to $1\times10^{14}\Omega$.

A supply bias is typically applied to the supply roller 105. The supply bias has a value in which the developing bias is offset in the same direction as the charge polarity of the toner.

The supply bias acts so that toner particles which are precharged at the contact point of the supply roller 105 with the developing roller 103 are attracted to the developing roller 103. The offset direction and quantity of the supply bias are not particularly limited, and depend on the kind of toner used. The supply roller 105 typically rotates in the counterclockwise direction, as shown in FIG. 1, so that toner particles adhered thereto are applied (supplied) to the surface of the developing roller 103. The developing roller 103 comprises a roller covered with an elastic rubber layer, the surface of which is further covered with a coating layer including a material easily chargeable to the reverse polarity to the toner. The elastic rubber layer has a JIS-A hardness of not greater than 50 so as to evenly contact the photoreceptor 2. The elastic rubber layer has an electric resistance of from $1\times10^{10}$ to $1\times10^{23}\Omega$ so that the developing bias can act thereon. The elastic rubber layer has a surface roughness Ra of from 0.2 to 2.0 μm so that a necessary amount of toner particles are held thereon. The developing roller 103 rotates in the counterclockwise direction so that the toner particles adhered thereon are transported to the position facing the toner layer thickness control member 104 and the photoreceptor 2. The toner layer thickness control member 104 includes a metallic spring material such as SUS304CSP, SUS301CSP, and phosphor bronze, and the free end thereof is pressed on the surface of the developing roller 103 with a pressing force of from 20 to 100 N/m. When toner particles pass through the metallic spring material upon application of the pressing force, a thin toner layer is formed; and the toner particles are friction-charged. Further, a control bias having a value such that the developing bias is offset in the same direction as the charge polarity of the toner is applied to the toner layer thickness control member 104 in order to assist friction-charging toner particles. The photoreceptor 2 typically rotates in the clockwise direction, as shown in FIG. 1, and therefore the photoreceptor 2 and the surface of the developing roller 103 typically move in the same direction at the point where they face one another. The developing roller 103 rotates so that the thin toner layer is transported to the facing point with the photoreceptor 2, and then the thin toner layer moves onto the surface of the photoreceptor 2 due to the developing bias applied to the developing roller 103 and the electric field produced by the latent image formed on the photoreceptor 2. In order to prevent toner particles that do not move onto the photoreceptor 2 and remain on the developing roller 103 from getting out of the developing device, a seal member 108 is provided, in this example in contact with the developing roller 103.

Having generally described certain embodiments of the invention, further understanding can be obtained by reference to certain specific examples which are provided herein for the purpose of illustration only and which are not intended to be limiting. In the descriptions in the following examples, the numbers represent weight ratios in parts, unless otherwise specified.

EXAMPLES

One Example of Preparation of Wax-containing Resin (A)

In one example of preparation of the Resin (A), vinyl monomers (3.9 mol of styrene, 0.4 mol of butyl acrylate, and 0.1 mol of hexyl acrylate) and a polymerization initiator (0.1 mol of dicumyl peroxide) are contained in a dropping funnel. In this example, a four-neck glass flask equipped with a thermometer, a stainless stirrer, a flow down condenser, and a nitrogen inlet pipe is charged with alcohol polyester monomers (0.2 mol of ethylene oxide adduct of bisphenol A and 2.0 mol of propylene oxide adduct of bisphenol A), acid polyester monomers (0.3 mol of acrylic acid, 0.2 mol of a succinic acid derivative, 0.3 mol of fumaric acid, 0.2 mol of trimellitic acid, and 1.0 mol of terephthalic acid), an esterification catalyst (12 mmol of dibutyl peroxide), and a wax (6 parts of a paraffin wax having a softening point of 72.7° C., based on 100 parts of monomers). The mixture contained in the four-neck glass flask is typically agitated and heated in a mantle heater under nitrogen atmosphere, while the mixture of the vinyl monomers and the polymerization initiator is dropped therein from the dropping funnel. The mixture is subjected to an addition polymerization reaction at a predetermined temperature, and subsequently heated so as to be subjected to a polycondensation reaction. The polymerization degree is traced by measuring a softening point of the product. The reaction is terminated when the product has a desired softening point, and then the product is cooled to room temperature. Thus, a wax-containing resin (A) is prepared. In this example, wax-containing resin (A) has a softening point of 139° C. and the wax has an average dispersion particle diameter of 3.8 μm.

One Example of Preparation of Wax-containing Resin (B)

In one example of preparation of Resin (B) vinyl monomers (3.9 mol of styrene, 0.3 mol of butyl acrylate, and 0.3 mol of hexyl acrylate) and a polymerization initiator (0.1 mol of 2,2'-azobisisobutylonitrile) are contained in a dropping funnel. A four-neck glass flask equipped with a thermometer, a stainless stirrer, a flow down condenser, and a nitrogen inlet pipe is charged with an alcohol polyester monomer (2.2 mol of propylene oxide adduct of bisphenol A), acid polyester monomers (0.3 mol of acrylic acid, 0.2 mol of a succinic acid derivative, 0.2 mol of fumaric acid, 0.2 mol of trimellitic acid, and 1.0 mol of terephthalic acid), an esterification catalyst (12 mmol of dibutyl peroxide), and a wax (5 parts of a paraffin wax having a softening point of 72.7° C., based on 100 parts of monomers). The mixture contained in the four-neck glass flask is agitated and heated in a mantle heater under nitrogen atmosphere, while the mixture of the vinyl monomers and the polymerization initiator is dropped therein from the dropping funnel. The mixture is subjected to an addition polymerization reaction at a predetermined temperature, and subsequently heated so as to be subjected to a polycondensation reaction. The polymerization degree is traced by measuring a softening point of the product. The reaction is terminated when the product has a desired softening point, and then the product is cooled to room temperature. Thus, a wax-containing resin (B) in this example is prepared. The wax-containing resin (B) has a softening point of 136° C. and the wax has an average dispersion particle diameter of 4.3 μm.

One Example of Preparation of Resin (C)

In one example of preparation of Resin (C), a four-neck glass flask equipped with a thermometer, a stainless stirrer, a flow down condenser, and a nitrogen inlet pipe is charged with 2.4 mol of ethylene oxide adduct of bisphenol A, 2.3 mol of propylene oxide adduct of bisphenol A, 0.6 mol of a succinic acid derivative, 1.2 mol of fumaric acid, 1.2 mol of trimellitic acid, 1.7 mol of terephthalic acid, and a polymerization initiator (dibutyl tin oxide). The mixture contained in the four-neck glass flask is agitated and heated in a mantle heater under nitrogen atmosphere. The polymerization degree is traced by measuring a softening point of the product. The reaction is terminated when the product has a desired softening point, and then the product is cooled to room temperature. Thus, a polyester resin (C) is prepared. The polyester resin (C) in this example has a softening point of 110° C. The above-prepared resins are typically coarsely pulverized so as to have a diameter of 1 mm or less.

Example 1

A binder resin R(m) is prepared by mixing 70% by weight of the resin (A), 30% by weight of the resin (B), and 43% by weight of the resin (C), based on total weight of the resins (A) and (B). A master batch including 5.0 parts of a naphthol colorant C. I. Pigment Red 57-1 is mixed with 100 parts by weight of the binder resin R(m) (including the wax) using a HENSCHEL MIXER, and the mixture is melt-kneaded with a kneader. The kneaded mixture is typically rolled by a cooling press roller so as to have a thickness of 2 mm. The rolled mixture is conveyed by a belt and coarsely pulverized by a feather mill. The pulverized particles are subjected to a coarse classification using a mechanical pulverizer (100AFG from Hosokawa Micron Corporation), and subsequently subjected to a fine classification using a rotor classifier (50ATP from Hosokawa Micron Corporation). Thus, in this example, a magenta mother toner having an average particle diameter of 8 μm is prepared.

Next, 100 parts by weight of the magenta mother toner is mixed with 1.0 part of a hydrophobized silica R972 (from Nippon Aerosil Co., Ltd.) and 1.0 part of a hydrophobized silica AEROSIL® 90G (from Nippon Aerosil Co., Ltd.) treated with hexamethylene disilazane (having a BET specific surface area of 65 $m^2/g$, a pH of 6.0, and a hydrophobic degree of 65% or more) using a HENSCHEL MIXER for 90 seconds at a revolution of 40 m/sec. The mixture is sieved with a mesh having an opening of 75 μm. Thus, a magenta toner is prepared.

The procedure for preparing the magenta toner is repeated except that the magenta colorant is replaced with a yellow colorant C. I. Pigment Yellow 180 and a cyan colorant C. I. Pigment Blue 15:3, respectively, and the binder resin R(m) is replaced with binder resins R(y) and R(c), respectively, having compositions described in Table 1. Thus, a yellow toner and a cyan toner are prepared.

Examples 2 to 7 and Comparative Examples 1 to 4

The procedures for preparing the magenta, yellow, and cyan toners in Example 1 are repeated except that the mixing ratios of the resins (A), (B), and (C) in the binder resins R(m), R(y), and R(c) and the amount of the wax contained in the resins (A) and (B) are changed to those described in Table 1, respectively.

Comparative Example 5

Resins (A') and (B') containing no wax and having the same softening point as the resins (A) and (B), respectively, are prepared. The procedures for preparing the magenta, yellow, and cyan toners in Example 1 are repeated except that the resins (A) and (B) are replaced with resins (A') and (B'), respectively, the mixing ratios of the resins (A'), (B'), and (C) in the binder resins R(m), R(y), and R(c) are changed to those described in Table 1, respectively. A specific amount of the wax is added to the mixture before melt-kneaded so that the resultant toner includes the wax in an amount described in Table 2.

TABLE 1

| | Binder resin R(m) for magenta toner | | | Binder resin R(y) for yellow toner | | | Binder resin R(c) for cyan toner | | | Amount of wax (% by weight) | |
|---|---|---|---|---|---|---|---|---|---|---|---|
| | Am(*) | Bm | Cm | Ay(**) | By | Cy | Ac(***) | Bc | Cc | Resin (A) | Resin (B) |
| Ex. 1 | 70 | 30 | 43 | 60 | 40 | 41 | 60 | 40 | 41 | 6 | 5 |
| Ex. 2 | 75 | 25 | 45 | 63 | 37 | 45 | 65 | 35 | 45 | 6 | 5 |
| Ex. 3 | 75 | 25 | 35 | 65 | 35 | 35 | 60 | 40 | 35 | 6 | 5 |
| Ex. 4 | 70 | 30 | 50 | 60 | 40 | 48 | 60 | 40 | 48 | 6 | 5 |
| Ex. 5 | 65 | 35 | 30 | 55 | 45 | 35 | 55 | 45 | 35 | 3 | 7 |
| Ex. 6 | 45 | 55 | 40 | 40 | 60 | 40 | 40 | 60 | 40 | 2 | 8 |
| Ex. 7 | 55 | 45 | 45 | 45 | 55 | 50 | 45 | 55 | 50 | 3 | 9 |
| Comp. Ex. 1 | 75 | 25 | 45 | 75 | 25 | 45 | 75 | 25 | 45 | 6 | 5 |
| Comp. Ex. 2 | 75 | 25 | 45 | 55 | 45 | 45 | 55 | 45 | 45 | 6 | 5 |
| Comp. Ex. 3 | 75 | 25 | 0 | 65 | 35 | 0 | 65 | 35 | 0 | 3 | 4 |
| Comp. Ex. 4 | 80 | 20 | 55 | 70 | 30 | 55 | 70 | 30 | 55 | 6 | 3 |
| Comp. Ex. 5 | 75 (A') | 25 (B') | 45 | 65 (A') | 35 (B') | 45 | 65 (A') | 35 (B') | 45 | 0 | 0 |

(*)Am, Bm, and Cm: Mixing ratio (% by weight) of resins (A), (B), and (C) in resin R(m), respectively, based on total weight of resins (A) and (B)
(**)Ay, By, and Cy: Mixing ratio (% by weight) of resins (A), (B), and (C) in resin R(y), respectively, based on total weight of resins (A) and (B)
(***)Ac, Bc, and Cc: Mixing ratio (% by weight) of resins (A), (B), and (C) in resin R(c), respectively, based on total weight of resins (A) and (B)

Evaluations (1) Softening Point (Tm)

The softening point of a toner is measured, for example, using a CFT-500 flowtester (from Shimadzu Corporation). At first, 1.5 g of a sample is weighed, and measured under the following conditions:

Die length: 1.0 mm
Die orifice diameter: 1.0 mm
Temperature rising rate: 3.0° C./min
Pre-heating time: 180 seconds
Test pressure: 30 kg
Measurement temperature range: 80 to 140° C.

The temperature at which the half (½) of the sample set in the flowtester has flowed out of the flowtester is defined as the softening point (Tm).

(2) Separability

A two-component developer, in which 5 parts of a toner and 95 parts of a silicone-coated carrier are mixed, is set in a modified full-color printer IPSIO CX7500 (manufactured and modified by Ricoh Co., Ltd.) from which the fixing device is detached. The modified full-color printer is adjusted so that a solid image including 1.0 to 1.2 mg/cm$^2$ of the toner is developed on a paper having a cross direction (TYPE 6200 from Ricoh Co., Ltd.) at a position 3 mm behind the tip thereof while the paper is fed in the vertical direction, and 6 sheets of the paper having an unfixed toner image thereon are produced.

A fixing device detached from a full-color copier IPSIO CX2500 (manufactured by Ricoh Co., Ltd.) is modified so that the temperature and the linear speed of the fixing belt are variable. Each of the unfixed toner images prepared above is fixed from the tip portion (i.e., 3 mm-wide margin) thereof using the modified fixing device at a linear speed of 125 mm/sec and a temperature of from 140 to 190° C. in increments of 10° C., respectively. The separation property is evaluated by the number of sheets in which the unfixed image is normally fixed without causing problems that a paper is wound around the fixing belt, a paper is jammed like an accordion at the exit of the fixing device, etc. The separability is graded as follows.

Good: 5 or more of sheets are normally fixed.
Average: 3 to 4 sheets are normally fixed.
Poor: 2 or less of sheets are normally fixed.

(3) Image Glossiness

Similarity to the evaluation of the separativeness, the unfixed image is fixed using the modified fixing device at a linear speed of 125 mm/sec and a temperature of 160° C. The glossiness of the fixed image is measured with a gloss meter (manufactured by Nippon Denshoku Industries Co., Ltd.) at a light entry angle of 60°. Full-color images used in offices preferably have a glossiness of from 5% to 15%. The glossiness is graded as follows.

Good: not less than 5%

Average: not less than 3% and less than 5% (no problem in practical use)

Poor: less than 3% (having problem in practical use)

(4) Toner Adhesion to Control Blade

A running test in which 2,000 sheets of a printing pattern having a printing proportion of 6% are continuously produced is performed at 23° C. and 45% RH using a full-color printer CX3000 (manufactured by Ricoh Co., Ltd.) including the developing device illustrated in FIG. 1. After the running test, the developing roller and the image produced are visually observed and evaluated as follows.

Good: No striped pattern and patchy unevenness of toner are observed on the developing roller.

Average: A small amount of striped pattern and patchy unevenness of toner are observed on the developing roller, but no striped pattern is observed in the image produced. No problem in practical use.

Poor: A large amount of striped pattern and patchy unevenness of toner are observed on the developing roller, and striped hollow defect is also observed in the image produced. Having a problem in practical use.

The evaluation results are shown in Table 2.

TABLE 2

| | Amount of wax (% by weight) | | | Softening point (Tm) (° C.) | | | Evaluation Results | | |
|---|---|---|---|---|---|---|---|---|---|
| | M | Y | C | M | Y | C | Separativeness | Glossiness | Toner adhesion |
| Ex. 1 | 3.3 | 3.3 | 3.3 | 129.7 | 129.0 | 129.2 | Good | Good | Good |
| Ex. 2 | 3.2 | 3.1 | 3.1 | 128.6 | 128.5 | 128.4 | Good | Good | Good |
| Ex. 3 | 3.7 | 3.7 | 3.6 | 132.4 | 132.9 | 133.8 | Good | Good | Average |
| Ex. 4 | 2.9 | 2.9 | 2.9 | 125.8 | 125.5 | 126.0 | Average | Good | Good |
| Ex. 5 | 3.1 | 3.1 | 3.1 | 134.3 | 133.9 | 134.0 | Good | Good | Good |
| Ex. 6 | 3.2 | 3.4 | 3.4 | 131.7 | 132.0 | 132.0 | Average | Good | Good |
| Ex. 7 | 3.1 | 3.2 | 3.2 | 130.0 | 130.1 | 129.9 | Good | Good | Average |
| Comp. Ex. 1 | 3.2 | 3.2 | 3.2 | 128.6 | 126.7 | 126.9 | Good | Good | Poor |
| Comp. Ex. 2 | 3.2 | 3.1 | 3.1 | 128.6 | 131.8 | 132.0 | Average | Poor | Good |
| Comp. Ex. 3 | 3.3 | 3.4 | 3.4 | 138.6 | 138.1 | 138.3 | Poor | Poor | Good |
| Comp. Ex. 4 | 3.1 | 3.0 | 3.0 | 123.2 | 123.7 | 123.2 | Poor | Good | Poor |
| Comp. Ex. 5 | 3.2 | 3.2 | 3.2 | 129.5 | 128.7 | 129.0 | Poor | Average | Poor |

Having now described multiple aspects of the invention, it will be apparent to one of ordinary skill in the art that many changes and modifications can be made thereto without departing from the spirit and scope of the invention as set forth therein.

The invention claimed is:

1. A full-color toner kit, comprising:

a yellow toner including a benzimidazolone colorant, resins (A) and (B) each of which including a polyester skeleton and a wax, the yellow toner further including a resin (C) including a polyester skeleton and no wax;

a magenta toner including a naphthol colorant and the resins (A), (B), and (C); and a cyan toner including a copper phthalocyanine colorant, the resins (A), (B), and (C), wherein each of the yellow, magenta, and cyan toners has a softening point of from 125° C. to 135° C., wherein the following relationships are satisfied:

$$Ts(A)<Ts(B)$$

$$Ay+5\leqq Am\leqq Ay+15$$

$$Ac+5\leqq Am\leqq Ac+15$$

wherein Ts(A) and Ts(B) (° C.) each represent softening points of the resin (A) and (B), respectively; and Ay, Am, and Ac each represent ratios (% by weight) of an amount of the resin (A) to total amount of the resins (A) and (B) in the yellow, magenta, cyan toners, respectively.

2. The full-color toner kit according to claim 1, wherein the following relationships are satisfied:

$$130\leqq Ts(A)\leqq 140$$

$$135\leqq Ts(B)\leqq 145$$

$$105<Ts(C)\leqq 115$$

wherein Ts(A), Ts(B), and Ts(C) (° C.) each represent softening points of the resins (A), (B), and (C), respectively.

3. The full-color toner kit according to claim 1, wherein the wax includes a paraffin wax.

4. The full-color toner kit according to claim 1, wherein each of the yellow, magenta, cyan toners includes the wax in an amount of from 3.0 to 3.5 parts by weight based on 100 parts by weight of each of the toner.

5. The full-color toner kit according to claim 1, wherein the wax has a softening point of from 70° C. to 80° C.

6. The full-color toner kit according to claim 1, wherein the wax dispersed in each the resins (A) and (B) has a number average dispersion diameter of from 3 μm to 5 μm.

7. The full-color toner kit according to claim 1, wherein each of the resins (A) and (B) includes the wax in an amount of from 3% to 8% by weight.

8. The full-color toner kit according to claim 1, wherein each of the yellow, magenta, and cyan toners includes each of the colorant in an amount of from 1.0% to 15% by weight.

9. A process cartridge, comprising:

an image bearing member configured to bear a latent image; and a developing device including, a toner bearing member configured to bear a toner which develops the latent image formed on the image bearing member, provided facing the image bearing member;

a supply member configured to supply the toner to the toner bearing member, provided facing and contacting the toner bearing member;

a thickness control member configured to form a thin layer of the toner supplied from the supply member on the toner bearing member, disposed so that a flat portion thereof faces and contacts the toner bearing member at a point located downstream from a point where the toner bearing member faces the supply member and upstream from a point where the toner bearing member faces the image bearing member, relative to a moving direction thereof;

a toner supply mechanism provided on an upper portion of the developing device; and the full-color toner kit according to claim 1.

10. The full-color toner kit according to claim 1, wherein each of the yellow, magenta, cyan toners is manufactured by a method comprising:

melt-kneading toner components comprising each of the colorant and the resins A, B, and C to prepare a kneaded mixture; and pulverizing the kneaded mixture to prepare toner particles.

11. The full-color toner kit according to claim 1, wherein the wax includes no ester group.

12. The full-color toner kit according to claim 1, wherein the wax includes no amide group.

13. An image forming method, comprising:

forming a latent image on an image bearing member;

providing a full-color toner kit including, a yellow toner including a benzimidazolone colorant, resins (A) and (B) each of which including a polyester skeleton and a wax, and a resin (C) including a polyester skeleton and no wax, a magenta toner including a naphthol colorant and the resins (A), (B), and (C), and a cyan toner including a copper phthalocyanine colorant, the resins (A), (B), and (C), wherein each of the yellow, magenta, and cyan toners has a softening point of from 125° C. to 135° C., wherein the following relationships are satisfied:

$$Ts(A)<Ts(B)$$

$$Ay+5 \leqq Am \leqq Ay+15$$

$$Ac+5 \leqq Am \leqq Ac+15$$

wherein Ts(A) and Ts(B) (° C.) each represent softening points of the resin (A) and (B), respectively; and Ay, Am, and Ac each represent ratios (% by weight) of an amount of the resin (A) to total amount of the resins (A) and (B) in the yellow, magenta, cyan toners, respectively;

supplying a toner contained in the full-color toner kit to a toner bearing member; and forming a thin layer of the toner on the toner bearing member to develop the latent image with the toner.

14. The image forming method of claim 13, further comprising:

manufacturing each of the yellow, magenta, cyan toners by a process including, melt-kneading toner components comprising each of the colorant and the resins A, B, and C to prepare a kneaded mixture; and pulverizing the kneaded mixture to prepare toner particles.

* * * * *